US011421510B2

(12) United States Patent
Otaibi

(10) Patent No.: US 11,421,510 B2
(45) Date of Patent: Aug. 23, 2022

(54) DOWNHOLE TOOL ASSEMBLIES FOR DRILLING WELLBORES AND METHODS FOR OPERATING THE SAME

(71) Applicant: Saudi Arabian Oil Company, Dhahran (SA)

(72) Inventor: Mohammed M. Otaibi, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/137,878

(22) Filed: Dec. 30, 2020

(65) Prior Publication Data

US 2022/0205339 A1 Jun. 30, 2022

(51) Int. Cl.
*E21B 37/04* (2006.01)
*E21B 4/02* (2006.01)

(52) U.S. Cl.
CPC ..... *E21B 37/04* (2013.01); *E21B 4/02* (2013.01)

(58) Field of Classification Search
CPC ..... E21B 10/26; E21B 10/32; E21B 10/322; E21B 29/08; E21B 10/30
See application file for complete search history.

(56) References Cited

U.S. PATENT DOCUMENTS 3,556,233 A 1/1971 Gilreath et al.
4,433,738 A * 2/1984 Moreland ..... E21B 10/30 175/349
5,201,817 A 4/1993 Hailey
5,351,758 A 10/1994 Henderson et al.
9,915,101 B2 * 3/2018 Mahajan ..... E21B 10/322
10,704,332 B2 7/2020 Hird et al.
2005/0274547 A1 * 12/2005 Fincher ..... E21B 7/20 175/57
2010/0288557 A1 * 11/2010 Radford ..... E21B 34/14 175/57
2011/0220357 A1 * 9/2011 Segura ..... E21B 29/002 166/298

(Continued)

FOREIGN PATENT DOCUMENTS

WO 2015054227 A2 4/2015

OTHER PUBLICATIONS

International Search Report and Written Opinion dated Oct. 27, 2021 pertaining to International application No. PCT/US2021/018667 filed Feb. 19, 2021, 22 pages.

(Continued)

*Primary Examiner* — David Carroll
(74) *Attorney, Agent, or Firm* — Dinsmore & Shohl LLP

(57) ABSTRACT

A downhole tool assembly coupled to a drill string includes a drill string motor that rotates the drill string, the downhole tool assembly including a tool body defining a perimeter, one or more cutting elements positioned on the perimeter of the tool body, where the one or more cutting elements are positionable between an extended position, in which the one or more cutting elements extend outwardly from the perimeter of the tool body, and a retracted position, where the one or more cutting elements are positioned further outward from the perimeter of the tool body in the extended position than the retracted position, and a tool motor coupled to the tool body, where the tool motor is structurally configured to rotate the tool body as fluid passes through the tool motor.

9 Claims, 7 Drawing Sheets

(56) References Cited

U.S. PATENT DOCUMENTS

| | | | | |
|---|---|---|---|---|
| 2011/0266060 | A1* | 11/2011 | Radford | E21B 10/322 175/57 |
| 2015/0027780 | A1 | 1/2015 | Hern et al. | |
| 2019/0162046 | A1 | 5/2019 | Engevik et al. | |

OTHER PUBLICATIONS

Atlasov, et al., "Development of Drilling and Casing Technologies for Permafrost Areas", International Science and Technology Conference, IOP Conf. Series: Earth and Environmental Services Science 272, 2019.

Herbig et al., "Reaming and Drilling PRactice Optimization using Modeling and Simulation Techniques", Society of Petroleum and Engineers, SPE-180287-MS, 13 pages, 2016.

Smith et al., "Successful Application of Innovative Reaming-While-Drilling Technology in Williston Basin Wells", 20th Annual Williston Basin Petroleum Conference, 2012.

Tercel Oilfield Productions, "Accelerating the Oilfield, Empowering the Industry", 2017.

Toro Downhole Tools, "Drilling Motor Handbook", 2015.

* cited by examiner

DOWNHOLE TOOL ASSEMBLIES FOR DRILLING WELLBORES AND METHODS FOR OPERATING THE SAME

BACKGROUND

Field

The present disclosure relates to downhole tool assemblies for drilling wellbores and methods for operating the same.

Technical Background

Wellbores may be drilled into the ground to extract fluids and/or gases from the ground. For example, petroleum within the ground may be extracted via wellbores drilled into the ground.

BRIEF SUMMARY

To drill a wellbore, downhole tool assemblies including cutting devices may be positioned on a drill string that is rotated within the wellbore. The wellbore may further undergo various processes to prepare the wellbore for production, and in some circumstances, cement may be pumped into the wellbore to seal portions of the wellbore. Downhole tool assemblies including cutting devices may be utilized to remove or "clean" the wellbore of cement and/or other debris that may be positioned in the wellbore.

At various points, it may be desirable to utilize cutting devices having different diameters during the drilling and/or cleaning processes. However, retrieving a downhole tool assembly from the wellbore, and replacing the downhole tool assembly with another downhole tool assembly having cutting devices with a different diameter may be time consuming and costly. Further, in deep wellbores in which comparatively long drill strings are utilized, significant energy may be required to rotate the downhole tool assembly by rotating the drill string, and it may be difficult to control the speed and/or torque of the downhole tool assembly.

Accordingly, a need exists for improved downhole tool assemblies drilling and/or cleaning a wellbore. Embodiments of the present disclosure are generally directed to downhole tool assemblies including a tool motor that can rotate a tool body of the downhole tool assembly independently of the rotation of the drill string. In embodiments, one or more cutting devices of the downhole tool assembly are movable between a retracted position and an extended position, where the one or more cutting elements are positioned further outward from a perimeter of the tool body in the extended position than the retracted position.

In one embodiment, a downhole tool assembly coupled to a drill string includes a drill string motor that rotates the drill string, the downhole tool assembly including a tool body defining a perimeter, one or more cutting elements positioned on the perimeter of the tool body, where the one or more cutting elements are positionable between an extended position, in which the one or more cutting elements extend outwardly from the perimeter of the tool body, and a retracted position, where the one or more cutting elements are positioned further outward from the perimeter of the tool body in the extended position than the retracted position, and a tool motor coupled to the tool body, where the tool motor is structurally configured to rotate the tool body as fluid passes through the tool motor.

In another embodiment, a downhole tool assembly includes a tool body defining a perimeter and an inner cavity in communication with a fluid source, one or more cutting elements positioned on the perimeter of the tool body, where the one or more cutting elements are positionable between an extended position, in which the one or more cutting elements extend outwardly from the perimeter of the tool body, and a retracted position, where the one or more cutting elements are positioned further outward from the perimeter of the tool body in the extended position than the retracted position, and an engagement device positioned at least partially within the inner cavity, where the engagement device is selectively engageable with the one or more cutting elements, the engagement device defining an aperture extending through the engagement device.

In yet another embodiment, a method for drilling a wellbore includes moving a downhole tool assembly down the wellbore, the downhole tool assembly including a tool body and one or more cutting elements coupled to the tool body, rotating a drill string coupled to the downhole tool assembly with a drill string motor coupled to the drill string, rotating the tool body of the downhole tool assembly with a tool motor coupled to the tool body, and moving the one or more cutting elements from a retracted position to an extended position, where the one or more cutting elements are positioned further outward from a perimeter of the tool body in the extended position than the retracted position.

Additional features and advantages of the technology disclosed in this disclosure will be set forth in the detailed description which follows, and in part will be readily apparent to those skilled in the art from the description or recognized by practicing the technology as described in this disclosure, including the detailed description which follows, the claims, as well as the appended drawings.

BRIEF DESCRIPTION OF THE DRAWINGS

The following detailed description of specific embodiments of the present disclosure can be best understood when read in conjunction with the following drawings, where like structure is indicated with like reference numerals and in which.

Reference will now be made in greater detail to various embodiments, some embodiments of which are illustrated in the accompanying drawings. Whenever possible, the same reference numerals will be used throughout the drawings to refer to the same or similar parts.

DETAILED DESCRIPTION

Embodiments of the present disclosure are generally directed to downhole tool assemblies including a tool motor that can rotate a tool body of the downhole tool assembly independently of the rotation of a drill string. In embodiments, one or more cutting devices of the downhole tool assembly are movable between a retracted position and an extended position, where the one or more cutting elements are positioned further outward from a perimeter of the tool body in the extended position than the retracted position. These and other embodiments will now be described with reference to the appended drawings.

As referred to herein, the term "axial direction" refers to a forward-rearward direction of the downhole tool assemblies described herein (e.g., the A-direction as depicted in the figures). As referred to herein, the term "radial direction" refers to a direction perpendicular to the axial direction A of the downhole tool assemblies described herein (e.g., the R-direction as depicted in the figures). As referred to herein, the term "circumferential direction" refers to a direction extending around the downhole tool assemblies described herein (e.g., the C-direction as depicted in the figures).

Figure 1:
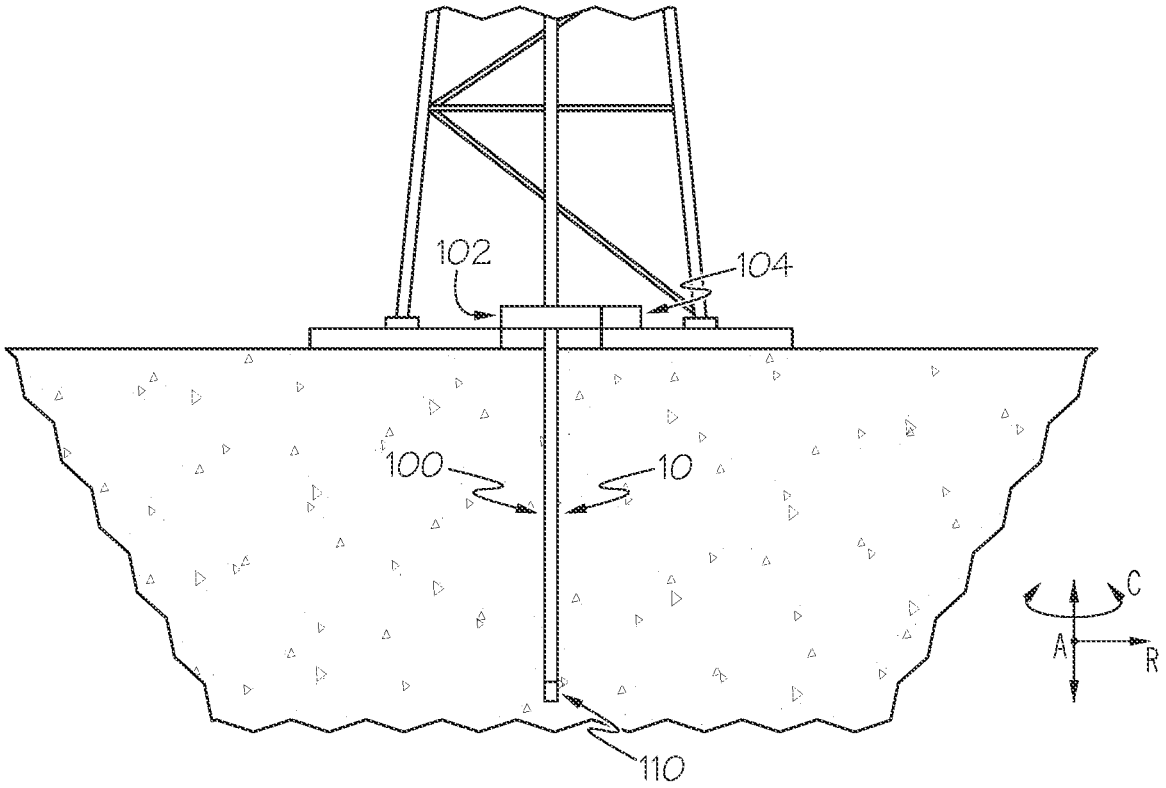
FIG. 1 schematically depicts a section view of wellbore and a drill string and downhole tool assembly positioned at least partially within the wellbore, according to one or more embodiments shown and described herein.

Now referring to FIG. 1, a section view of a drill string 100 extending into a wellbore 10 is schematically depicted. The wellbore 10 extends underground, and gases and/or fluids may be extracted from the ground via the wellbore 10. While in the embodiment depicted in FIG. 1 the drill string 100 is shown as extending directly into the ground (i.e., in a land-based wellbore 10), it should be understood that this is merely an example, and in some embodiments, the drill string 100 may be utilized in marine or offshore applications.

In some embodiments, the drill string 100 is coupled to a drill string motor 102 that is structurally configured to rotate the drill string 100 in the circumferential direction C. While in the embodiment depicted in FIG. 1 the drill string motor 102 is positioned at a location proximate to the surface, it should be understood that this is merely an example, and the drill string motor 102 may be positioned at any suitable location. For example, in some embodiments, the drill string motor 102 may be positioned at least partially within the wellbore 10. The drill string motor 102, in embodiments, may include any motor suitable to rotate the drill string 100, and may include for example and without limitation, a hydraulic motor, an internal combustion engine, a turbine engine, an electric motor, or the like.

In embodiments, a downhole tool assembly 110 is coupled to the drill string 100. While in the embodiment depicted in FIG. 1, the downhole tool assembly 110 is shown as being coupled to an end of the drill string 100, it should be understood that the downhole tool assembly 110 may be positioned at any suitable location of the drill string 100. Further, while in the embodiment depicted in FIG. 1, the drill string 100 is depicted as including a single downhole tool assembly 110, it should be understood that embodiments described herein may include multiple downhole tool assemblies 110 positioned along the drill string 100. Additionally, while the wellbore 10 of FIG. 1 is depicted as extending in a vertical direction, it should be understood that this is merely illustrative, and downhole tool assemblies 110 according to the present disclosure may be utilized in wellbores 10 extending in any suitable direction (e.g., in a horizontal direction or at least partially in the horizontal direction).

In some embodiments, a fluid source 104 is in communication with the drill string 100. The fluid source 104 may supply a fluid, such as drilling fluid or the like, to the drill string 100. In some embodiments, the fluid source 104 may include a pump or the like that pressurizes fluid, pumping the fluid through the drill string 100 to the downhole tool assembly 110, as described in greater detail herein.

Figure 2:
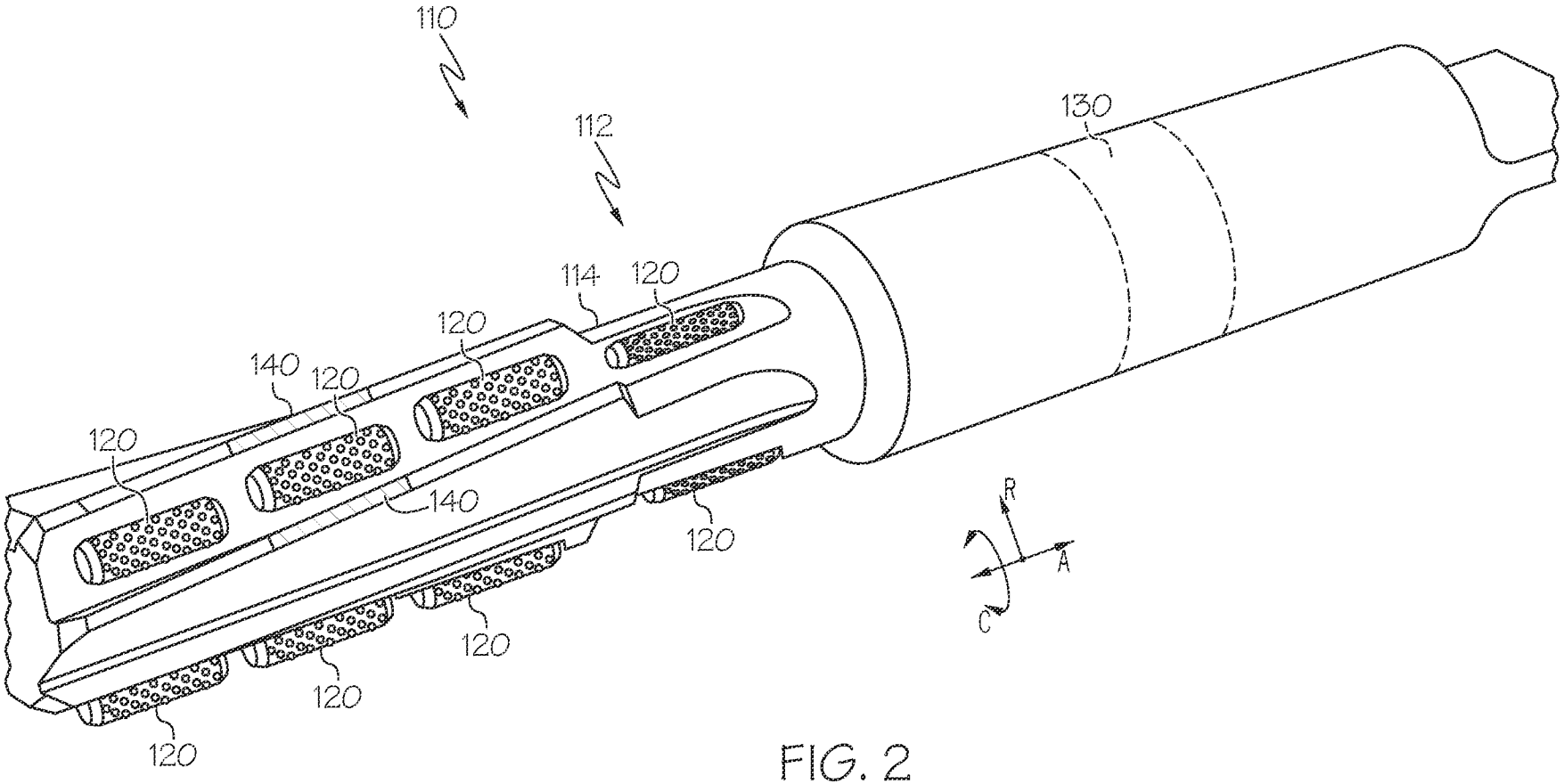
FIG. 2 schematically depicts a perspective view of the downhole tool assembly of FIG. 1, according to one or more embodiments shown and described herein.

Referring to FIG. 2, a perspective view of the downhole tool assembly 110 is schematically depicted. In embodiments, the downhole tool assembly 110 includes a tool body 112 defining a perimeter 114. In some embodiments, the tool body 112 may have a generally cylindrical shape and the perimeter 114 may be a circumference of the tool body 112, however, it should be understood that this is merely an example.

The downhole tool assembly 110, in embodiments, includes one or more cutting elements 120 positioned on the perimeter 114 of the tool body 112. In the embodiment depicted in FIG. 2, the one or more cutting elements 120 are roller-type cutting elements that are rotatable with respect to the tool body 112, however, it should be understood that this is merely an example. In embodiments, the one or more cutting elements 120 may be any suitable type of cutting elements for engaging the wellbore 10 (FIG. 1). Further, while eight cutting elements 120 are visible in the view of the downhole tool assembly 110 shown in FIG. 2, it should be understood that this is merely an example, and the downhole tool assembly 110 may include any suitable number of cutting elements 120 and may include a single cutting element 120. Engagement between the one or more cutting elements 120 and the wellbore 10 (FIG. 1) may assist in drilling or enlarging the wellbore 10.

In some embodiments, the downhole tool assembly 110 includes one or more casing scrapers 140 positioned on the perimeter 114 of the tool body 112. In embodiments, the one or more casing scrapers 140 may include blades or the like coupled to the tool body 112. In embodiments, the one or more casing scrapers 140 may assist in drilling or enlarging the wellbore 10 (FIG. 1). For example, the one or more casing scrapers 140 may assist in cleaning out cement, hardened mud, paraffin, or the like from the wellbore 10 (FIG. 1).

In some embodiments, the downhole tool assembly 110 includes a tool motor 130 coupled to the tool body 112. In embodiments, the tool motor 130 is structurally configured to rotate the tool body 112 as fluid passes through the tool motor 130.

Figure 3:
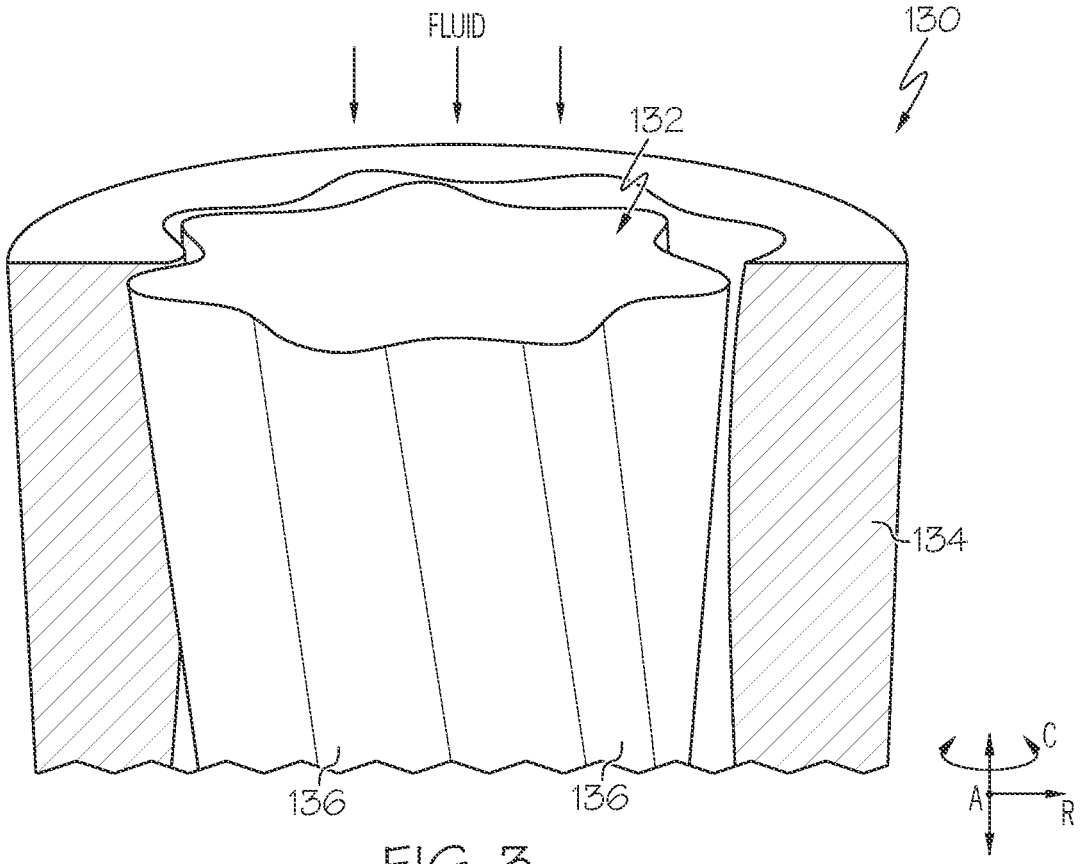
FIG. 3 schematically depicts a side section view of a tool motor of the downhole tool assembly of FIG. 1, according to one or more embodiments shown and described herein.
Figure 4:
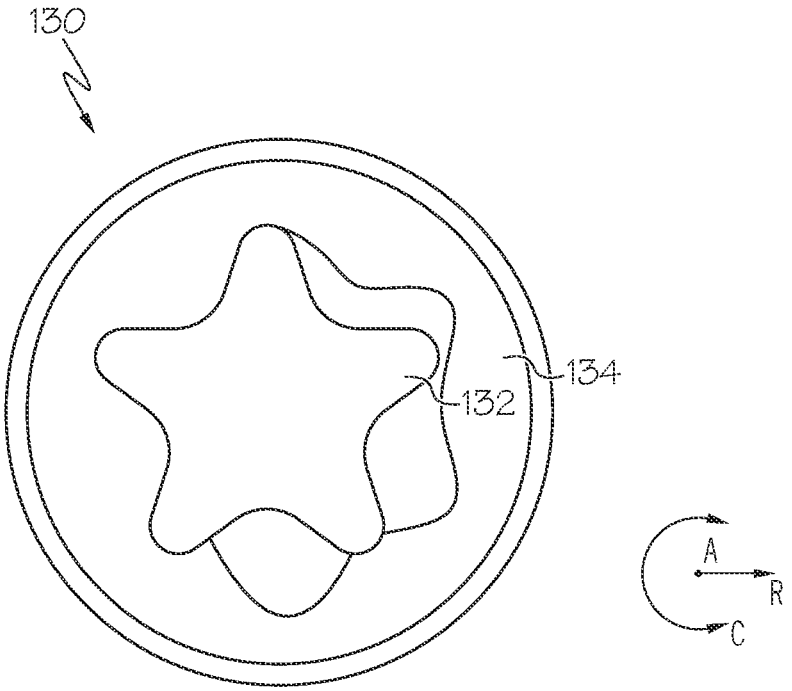
FIG. 4 schematically depicts a top section view of the tool motor of FIG. 3, according to one or more embodiments shown and described herein.

For example and referring to FIGS. 2, 3, and 4, a side section view and a top view of the tool motor 130 are depicted. In some embodiments, the tool motor 130 includes a rotor 132 engaged with a stator 134. In the embodiment depicted in FIGS. 3 and 4, the rotor 132 is positioned at least partially within the stator 134. The rotor 132, in some embodiments, includes a helical spline 136 or the like, such that fluid passing through the tool motor 130 in the axial direction A causes the rotor 132 to rotate in the circumferential direction C within the stator 134. In embodiments, the rotor 132 of the tool motor 130 is coupled to the tool body 112, such that rotation of the rotor 132 in the circumferential direction C causes the tool body 112 to rotate in the circumferential direction C. In embodiments, fluid may be passed from the fluid source 104 (FIG. 1) to the tool motor 130 via the drill string 100 to power the tool motor 130. While in the embodiment depicted in FIGS. 3 and 4 the tool motor 130 includes a single rotor 132 positioned at least partially within the stator 134, it should be understood that this is merely an example, and the tool motor 130 may include any suitable number of rotors 132 and stators 134. Further, while in the embodiment depicted in FIGS. 3 and 4 the rotor 132 is positioned at least partially within the stator 134, it should be understood that this is merely an example, and the rotor 132 and the stator 134 may be engaged in any suitable manner allowing the rotor 132 to rotate with respect to the stator 134. For example, in some embodiments, the rotor 132 may be an annular member that is positioned around the stator 134.

Via the tool motor 130, the tool body 112 may be rotated in the circumferential direction C independently of rotation of the drill string 100 (FIG. 1) by the drill string motor 102 (FIG. 1). Because the tool motor 130 may rotate the tool body 112 independently of the drill string 100 (FIG. 1), the tool motor 130 may rotate the tool body 112 of the downhole tool assembly 110 even when the drill string 100 (FIG. 1) is not rotating. Further, because the tool motor 130 may rotate the tool body 112 independently of the drill string 100 (FIG. 1), the tool body 112 of the downhole tool assembly 110 may rotate in the circumferential direction C at a different speed and/or torque as compared to the drill string 100. In this way, the tool motor 130 may provide greater control over the rotation of the downhole tool assembly 110 as compared to configurations that do not include the tool motor 130 and instead rely on the rotation of a drill string to rotate a downhole tool assembly.

Further, by rotating the tool body 112 independently of the drill string 100 (FIG. 1), the tool motor 130 may rotate the tool body 112 more efficiently than configurations in which the tool body 112 is rotated via the drill string 100. In particular and without being bound by theory, as the length of a drill string 100 (FIG. 1) increases, increased energy may be required to rotate the drill string 100 at a given speed and/or torque. Accordingly, in significantly deep wellbores 10 (FIG. 1), significant energy may be required to rotate the drill string 100 (FIG. 1) to rotate the tool body 112 at a desired speed and/or torque. Because the tool motor 130 rotates the tool body 112 without requiring rotation of the drill string 100 (FIG. 1), the amount of energy required to rotate the tool body 112 a desired speed and/or torque can be reduced as compared to conventional configurations in which the tool body 112 is rotated solely through rotation of the drill string 100. In this way, the tool motor 130 may reduce the amount of energy required to drill and/or clean the wellbore 10 (FIG. 1) as compared to conventional configurations.

Figure 5:
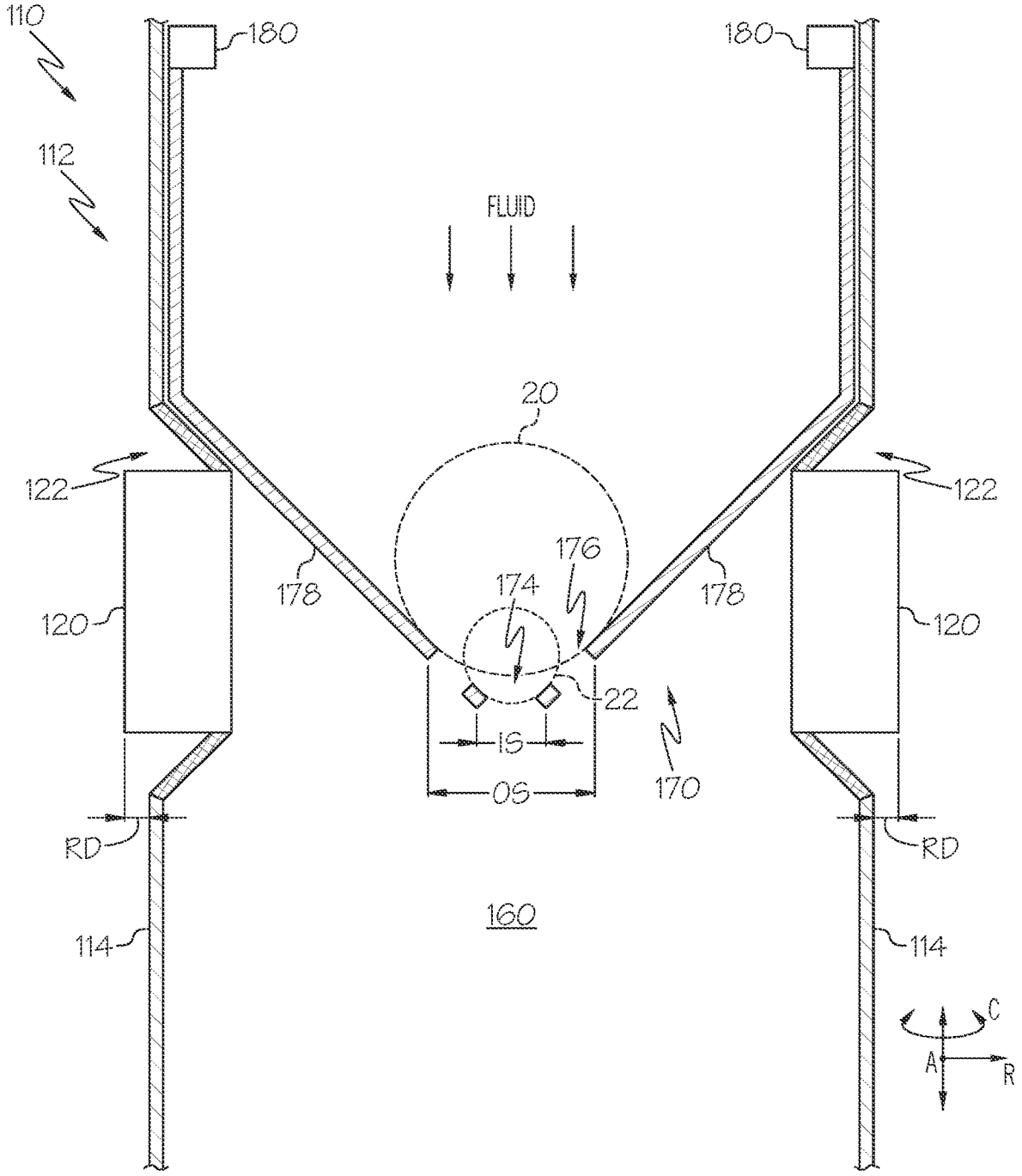
FIG. 5 schematically depicts a section view of a tool body of the downhole tool assembly of FIG. 1 with one or more cutting devices positioned in a retracted position.
Figure 6:
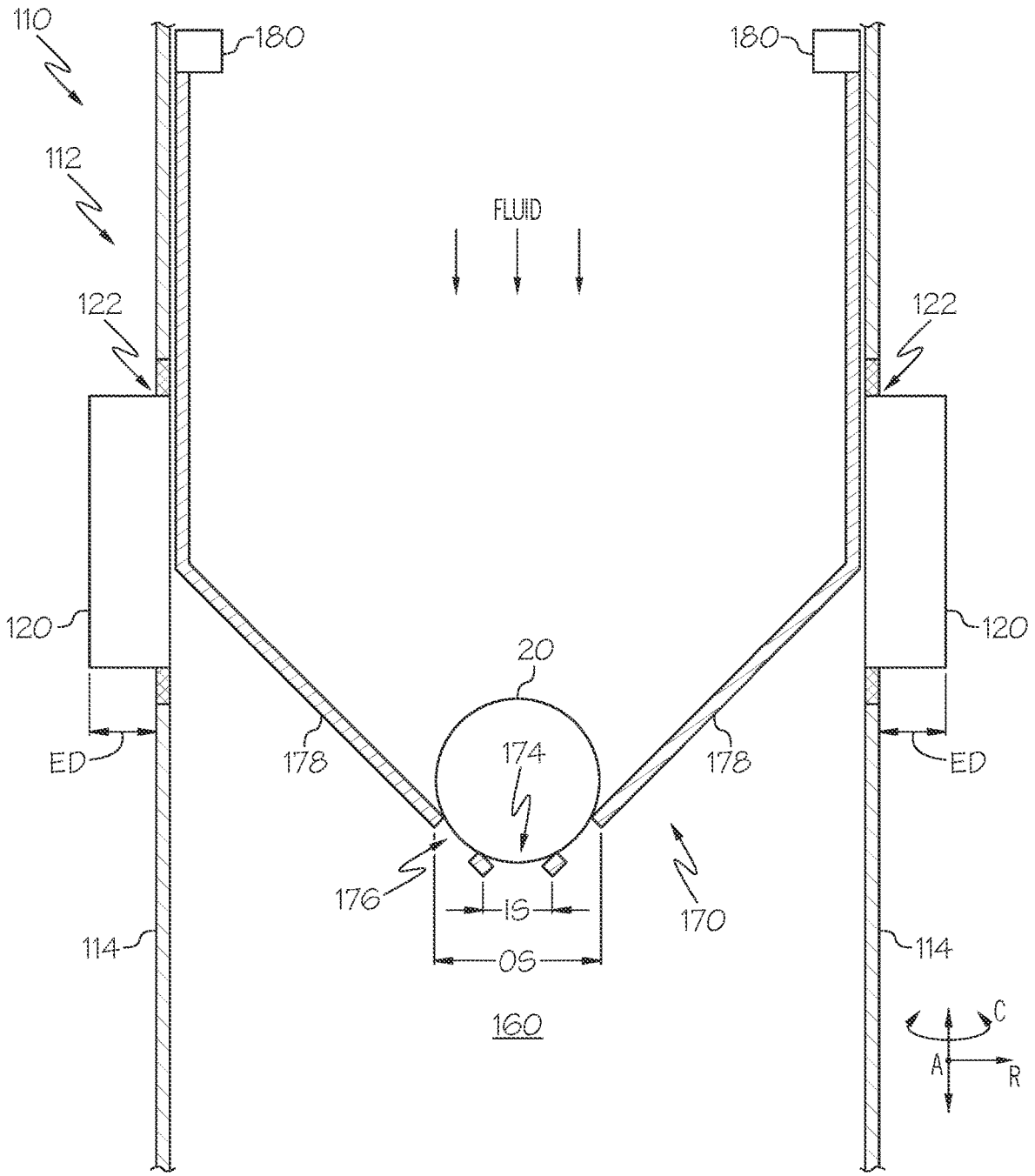
FIG. 6 schematically depicts a section view of the tool body of FIG. 5 with the one or more cutting devices positioned in an extended position.
Figure 7:
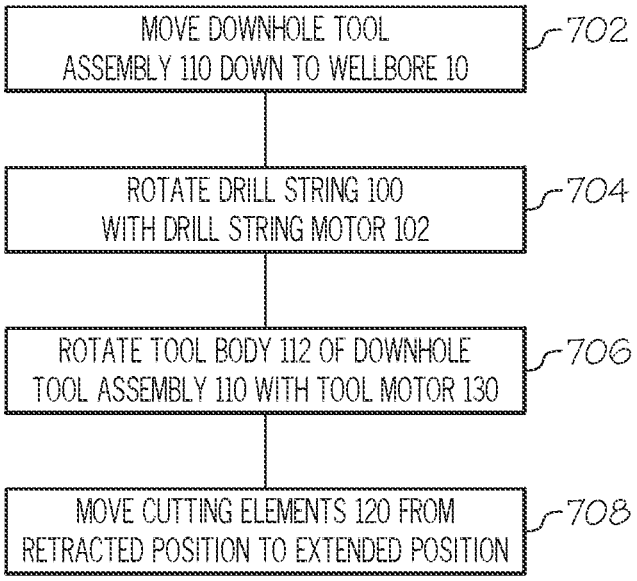
FIG. 7 is a flowchart of one method for drilling a wellbore with the downhole tool assembly of FIG. 1, according to one or more embodiments shown and described herein.

Referring to FIGS. 5 and 6, section views of the tool body 112 of the downhole tool assembly 110 are schematically depicted. In some embodiments, the tool body 112 defines an inner cavity 160. The inner cavity 160, in some embodiments, is in communication with the fluid source 104 (FIG. 1), for example, through the drill string 100 (FIG. 1).

In some embodiments, the one or more cutting elements 120 are coupled to the tool body 112 through one or more axle components 122, and may be rotatable with respect to the one or more axle components 122. In some embodiments, the one or more axle components 122 are movable with respect to the tool body 112 in the radial direction R, as described in greater detail herein.

In embodiments, the one or more cutting elements 120 are positionable between a retracted position, as shown in FIG. 5, and an extended position, as shown in FIG. 6. In the extended position as shown in FIG. 6, the one or more cutting elements 120 extend outwardly from the perimeter 114 of the tool body 112 (e.g., in the radial direction R). In the retracted positon as shown in FIG. 5, the one or more cutting elements 120 are positioned further inward (e.g., in the radial direction R) as compared to the extended position shown in FIG. 6. For example, in the retracted position shown in FIG. 5, the one or more cutting elements 120 extend outwardly from the perimeter 114 of the tool body 112 by a retracted distance RD. In the extended position shown in FIG. 6, the one or more cutting elements 120 extend outwardly from the perimeter 114 of the tool body 112 by an extended distance ED, where the extended distance ED is greater than the retracted distance RD (FIG. 5).

While in the embodiment depicted in FIG. 5, the one or more cutting elements 120 extend outwardly from the perimeter 114 of the tool body 112 in the retracted position, it should be understood that this is merely an example. For example, in some embodiments, the one or more cutting elements 120 may be generally aligned with the perimeter 114 of the tool body 112 in the retracted position (e.g., the retracted distance RD may be about zero). In some embodiments, the one or more cutting elements 120 may be positioned inward (i.e., in the radial direction R) of the perimeter 114 of the tool body 112 in the retracted position.

In some embodiments, the downhole tool assembly 110 includes an engagement device 170 positioned at least partially within the inner cavity 160. The engagement device 170, in embodiments, is selectively engageable with and is structurally configured to move the one or more cutting elements 120 from the retracted position, as shown in FIG. 5, to the extended position, as shown in FIG. 6.

In embodiments, the engagement device 170 is movable with respect to the tool body 112 in the axial direction A within the inner cavity 160 between an engaged position as shown in FIG. 5, and a disengaged position, as shown in FIG. 6. The engagement device 170, in some embodiments, may be moved with respect to the tool body 112 via a drop ball or drop balls. For example, in some embodiments, the engagement device 170 includes an aperture extending through the engagement device 170. In the embodiment depicted in FIGS. 5 and 6, as one example, the engagement device 170 includes an inner aperture 174 and an outer aperture 176 extending through the engagement device 170 in the axial direction A. In embodiments, the inner aperture 174 defines an inner aperture span IS, and the outer aperture 176 defines an outer aperture span OS, where the outer aperture span OS is greater than the inner aperture span IS. In some embodiments and shown in FIGS. 5 and 6, the inner aperture 174 is positioned at least partially within the outer aperture 176 in the radial direction R. For example, in the embodiment depicted in FIGS. 5 and 6 the outer aperture 176 may be an annular aperture surrounding the inner aperture 174. While in the embodiment depicted in FIGS. 5 and 6 the engagement device 170 includes the inner aperture 174 and the outer aperture 176, it should be understood that this is merely an example. Embodiments of the engagement device 170 described herein may include further apertures extending through the engagement device 170 or may include a single aperture extending through the engagement device 170.

In embodiments, drop balls may at least partially restrict the flow of fluid through the inner aperture 174 and/or the outer aperture 176. By restricting the flow of fluid through the inner aperture 174 and/or the outer aperture 176, the engagement device 170 moves within the inner cavity 160 of the tool body 112 in the axial direction A.

For example, in embodiments, fluid (e.g., fluid from the drill string 100 (FIG. 1)), may be passed through the inner cavity 160 of the tool body 112 in the axial direction A. As the fluid passes through the inner cavity 160 of the tool body 112, the fluid may generally pass through the inner aperture 174 and/or the outer aperture 176.

In embodiments, a drop ball 20 may be passed through the inner cavity 160 of the tool body 112. For example, the drop ball 20 may be passed through the drill string 100 (FIG. 1) via fluid passing through the drill string 100, and may be passed to the tool body 112. The drop ball 20 may pass through the tool body 112 to the inner aperture 174 and the outer aperture 176. The drop ball 20 may be positioned over the inner aperture 174 and/or the outer aperture 176, thereby at least partially blocking the passage of fluid through the inner aperture 174 and/or the outer aperture 176. For example, as shown in FIGS. 5 and 6, the drop ball 20 may have a span (e.g., a diameter) that is at least as great as the outer aperture span OS of the outer aperture 176, such that the drop ball 20 at least partially restricts the flow of fluid through the outer aperture 176. Because, in the embodiment depicted in FIGS. 5 and 6, the inner aperture 174 is positioned within the outer aperture 176, the drop ball 20 also at least partially restricts the flow of fluid through the inner aperture 174.

With the inner aperture 174 and the outer aperture 176 at least partially blocked by the drop ball 20, fluid passing through the tool body 112 in the axial direction A is restricted from flowing through the engagement device 170 in the axial direction A. The fluid may apply a pressure to the engagement device 170 in the axial direction A, thereby causing the engagement device 170 to move in the axial direction A, for example, from the disengaged position as shown in FIG. 5, to the engaged position as shown in FIG. 6.

As the engagement device 170 moves in the axial direction A, the engagement device 170 engages the one or more cutting elements 120, moving the one or more cutting elements 120 from the retracted position to the extended position. For example, in some embodiments, the engagement device 170 includes one or more engagement surfaces 178 that are structurally configured to engage the one or more axle components 122, moving the one or more axle components 122 and accordingly the one or more cutting elements into the extended position. For example, the one or more engagement surfaces 178 of the engagement device 170, in embodiments, face at least partially outward in the radial direction R. As the one or more engagement surfaces 178 engage the one or more axle components 122, the engagement device 170 may move the one or more axle components 122, and accordingly the one or more cutting elements 120 outward in the radial direction R. In this way, the engagement device 170 may move the one or more cutting elements 120 from the retracted position as shown in FIG. 5 to the extended position shown in FIG. 6.

Referring particularly to FIG. 6, as fluid continues to pass to the engagement device 170 and is restricted from flowing out through the inner aperture 174 and the outer aperture 176, fluid pressure may maintain the engagement device 170 in the engaged position, thereby maintaining the one or more cutting elements 120 in the extended position.

In embodiments, as fluid continues to flow in the axial direction A, pressure may build against the drop ball 20, eventually causing the drop ball 20 to fracture and pass through the inner aperture 174 and/or the outer aperture 176. Without the drop ball 20 at least partially obstructing the inner aperture 174 and the outer aperture 176, the fluid can pass through the inner aperture 174 and/or the outer aperture 176, and the one or more cutting elements 120 are no longer maintained in the extended position. In some embodiments, the engagement device 170 may be engaged with one or more biasing members 180 that bias the engagement device 170 into the disengaged position shown in FIG. 5. For example, in the embodiment depicted in FIGS. 5 and 6, the one or more biasing members 180 may bias the engagement device 170 in the axial direction A, moving the engagement device 170 into the disengaged position once the drop ball 20 breaks. The one or more biasing members 180 may include any suitable devices to bias the engagement device 170 into the disengaged position, and may include for example and without limitation, springs or the like.

In embodiments, the downhole tool assembly 110 may be utilized to drill the wellbore 10 (FIG. 1) and may be used in drilling and/or cementing clean out processes to clear material in the wellbore 10. Because the one or more cutting elements 120 are movable between the extended position and the retracted position, a working diameter of the downhole tool assembly 110 (e.g., an effective diameter of the downhole tool assembly 110 defined by the one or more cutting elements 120) can be varied while the downhole tool assembly 110 is positioned within the wellbore 10 (FIG. 1). By varying the working diameter of the downhole tool assembly 110 within the wellbore 10 (FIG. 1), it is not necessary to retrieve and replace the downhole tool assembly 110 from the wellbore 10 to change the working diameter of the downhole tool assembly 110. Because it is unnecessary to retrieve and replace the downhole tool assembly 110 to change the working diameter, the amount of time required to drill and/or clean the wellbore 10 (FIG. 1) may be reduced as compared to conventional configurations.

In some embodiments and as shown in FIG. 5, the drop ball 20 may be a large drop ball that extends over the outer aperture 176 and the inner aperture 174. In embodiments, a smaller drop ball 22 may be utilized, where the small drop ball 22 has a smaller diameter than the large drop ball 20.

For example, in some embodiments, a small drop ball 22 may be passed to the downhole tool assembly 110 through the drill string 100 (FIG. 1). The small drop ball 22 may pass to the engagement device 170, and may be positioned over the inner aperture 174. With the small drop ball 22 positioned over the inner aperture 174, the small drop ball 22 may restrict the flow of fluid through the inner aperture 174.

However, in some embodiments, the diameter of the small drop ball 22 is less than the outer span OS of the outer aperture 176. Accordingly, with the small drop ball 22 positioned over the inner aperture 174, fluid may be restricted from flowing through the inner aperture 174, but may still pass through the outer aperture 176. Because fluid can pass through the outer aperture 176, less fluid pressure may be generated, and the engagement device 170 may move less in the axial direction A as compared to when a large drop ball 20 is positioned over the inner aperture 174 and the outer aperture 176. Because the engagement device 170 moves less in the axial direction A, the one or more cutting elements 120 may move outwardly in the radial direction R less than when a large drop ball 20 is utilized to cover the inner aperture 174 and the outer aperture 176. In this way, different sized drop balls may be utilized to control the radial position of the one or more cutting elements 120. While in the embodiment depicted in FIGS. 5 and 6, the inner aperture 174 and outer aperture 176 correspond to the drop ball 22 and the drop ball 20, respectively, it should be understood that engagement devices 170 according to the present disclosure may include any suitable number of different sized apertures corresponding to different sized drop balls to move the one or more cutting elements 120 outwardly in the radial direction R.

Referring to FIGS. 1, 2, 5, 6, and 7, a flowchart of one method for drilling a wellbore 10 is depicted. In a first block 702, the downhole tool assembly 110 is moved down the wellbore 10. In a second block 704, the drill string 100 is rotated with the string motor 102 coupled to the drill string 100. In a third block 706, the tool body 112 of the downhole tool assembly 110 is rotated with the tool motor 130 coupled to the tool body 112. As described above, the tool motor 130 may rotate the tool body 112, for example as the result of fluid flowing through the tool motor 130. In a fourth block 708, the one or more cutting elements 120 are moved from the retracted position to the extended position. As noted above, the one or more cutting elements 120 may be moved from the retracted position to the extended position via the drop balls 20, 22, and the engagement device 170.

Accordingly, it should now be understood that embodiments of the present disclosure are generally directed to downhole tool assemblies including a tool motor that can rotate a tool body of the downhole tool assembly independently of the rotation of the drill string. By utilizing a tool motor that can rotate the tool body independently of the rotation of the drill string, the energy required to rotate the tool body may be reduced, and the speed and/or torque of the tool body may be more easily controlled as compared to conventional configurations. In embodiments, one or more cutting devices of the downhole tool assembly are movable between a retracted position and an extended position, where the one or more cutting elements are positioned further outward from a perimeter of the tool body in the extended position than the retracted position. By moving the one or more cutting devices between the retracted position and the extended position within a wellbore, it is not necessary to retrieve and replace the downhole tool assembly to change a working diameter of the downhole tool assembly.

Having described the subject matter of the present disclosure in detail and by reference to specific embodiments, it is noted that the various details described in this disclosure should not be taken to imply that these details relate to elements that are essential components of the various embodiments described in this disclosure, even in cases where a particular element is illustrated in each of the drawings that accompany the present description. Rather, the appended claims should be taken as the sole representation of the breadth of the present disclosure and the corresponding scope of the various embodiments described in this disclosure. Further, it should be apparent to those skilled in the art that various modifications and variations can be made to the described embodiments without departing from the spirit and scope of the claimed subject matter. Thus it is intended that the specification cover the modifications and variations of the various described embodiments provided such modifications and variations come within the scope of the appended claims and their equivalents.

It is noted that recitations herein of a component of the present disclosure being "structurally configured" in a particular way, to embody a particular property, or to function in a particular manner, are structural recitations, as opposed to recitations of intended use. More specifically, the references herein to the manner in which a component is "structurally configured" denotes an existing physical condition of the component and, as such, is to be taken as a definite recitation of the structural characteristics of the component.

It is noted that terms like "preferably," "commonly," and "typically," when utilized herein, are not utilized to limit the scope of the claimed invention or to imply that certain features are critical, essential, or even important to the structure or function of the claimed invention. Rather, these terms are merely intended to identify particular aspects of an embodiment of the present disclosure or to emphasize alternative or additional features that may or may not be utilized in a particular embodiment of the present disclosure.

For the purposes of describing and defining the present invention it is noted that the terms "substantially" and "about" are utilized herein to represent the inherent degree of uncertainty that may be attributed to any quantitative comparison, value, measurement, or other representation. The terms "substantially" and "about" are also utilized herein to represent the degree by which a quantitative representation may vary from a stated reference without resulting in a change in the basic function of the subject matter at issue.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. A downhole tool assembly coupled to a drill string comprising a drill string motor that rotates the drill string, the downhole tool assembly comprising:

a tool body defining a perimeter;

one or more cutting elements positioned on the perimeter of the tool body, wherein the one or more cutting elements are positionable between an extended position, in which the one or more cutting elements extend outwardly from the perimeter of the tool body, and a retracted position, wherein the one or more cutting elements are positioned further outward from the perimeter of the tool body in the extended position than the retracted position; and a tool motor coupled to the tool body, wherein the tool motor is structurally configured to rotate the tool body as fluid passes through the tool motor, wherein the tool motor comprises a rotor coupled to the tool body and engaged with a stator, and the rotor defines a helical spline such that fluid passing through the tool motor in an axial direction causes the rotor to rotate in a circumferential direction within the stator.

2. A downhole tool assembly coupled to a drill string comprising a drill string motor that rotates the drill string, the downhole tool assembly comprising:

a tool body defining a perimeter;

one or more cutting elements positioned on the perimeter of the tool body, wherein the one or more cutting elements are positionable between an extended position, in which the one or more cutting elements extend outwardly from the perimeter of the tool body, and a retracted position, wherein the one or more cutting elements are positioned further outward from the perimeter of the tool body in the extended position than the retracted position;

a tool motor coupled to the tool body, wherein the tool motor is structurally configured to rotate the tool body as fluid passes through the tool motor, wherein the tool body defines an inner cavity in communication with a fluid source; and an engagement device positioned at least partially within the inner cavity, wherein the engagement device selectively moves the one or more cutting elements from the retracted position to the extended position, and the engagement device defines an inner aperture having an inner aperture span and an outer aperture having an outer aperture span that is greater than the inner aperture span, the inner aperture and the outer aperture extending through the engagement device.

3. A downhole tool assembly coupled to a drill string comprising a drill string motor that rotates the drill string, the downhole tool assembly comprising:

a tool body defining a perimeter and an inner cavity in communication with a fluid source;

one or more cutting elements positioned on the perimeter of the tool body, wherein the one or more cutting elements are positionable between an extended position, in which the one or more cutting elements extend outwardly from the perimeter of the tool body, and a retracted position, wherein the one or more cutting elements are positioned further outward from the perimeter of the tool body in the extended position than the retracted position;

a tool motor coupled to the tool body, wherein the tool motor comprises a rotor coupled to the tool body and engaged with a stator and is structurally configured to rotate the tool body as fluid passes through the tool motor; and an engagement device positioned at least partially within the inner cavity, the engagement device selectively moves the one or more cutting elements from the retracted position to the extended position and defines an inner aperture and an outer aperture extending through the engagement device, the inner aperture defining an inner aperture span and the outer aperture defining an outer aperture span that is greater than the inner aperture span.

4. A downhole tool assembly comprising:

a tool body defining a perimeter and an inner cavity in communication with a fluid source;

one or more cutting elements positioned on the perimeter of the tool body, wherein the one or more cutting elements are positionable between an extended position, in which the one or more cutting elements extend outwardly from the perimeter of the tool body, and a retracted position, and the one or more cutting elements are positioned further outward from the perimeter of the tool body in the extended position than the retracted position; and an engagement device positioned at least partially within the inner cavity, wherein the engagement device is selectively engageable with the one or more cutting elements, and the engagement device defines an inner aperture having an inner aperture span and an outer aperture having an outer aperture span that is greater than the inner aperture span, the inner aperture and the outer aperture extending through the engagement device.

5. The downhole tool assembly of claim 4, further comprising one or more casing scrapers positioned on the perimeter of the tool body.

6. The downhole tool assembly of claim 4, further comprising a tool motor comprising a rotor coupled to the tool body and positioned at least partially within a stator.

7. The downhole tool assembly of claim 4, further comprising one or more biasing members engaged with the engagement device.

8. A method for drilling a wellbore, the method comprising:

moving a downhole tool assembly down the wellbore, the downhole tool assembly comprising a tool body and one or more cutting elements coupled to the tool body;

rotating a drill string coupled to the downhole tool assembly with a drill string motor coupled to the drill string;

rotating the tool body of the downhole tool assembly with a tool motor coupled to the tool body;

moving the one or more cutting elements from a retracted position to an extended position where the one or more cutting elements are positioned further outward from a perimeter of the tool body, by moving a first drop ball having a first drop ball diameter over a first aperture of an engagement device, the engagement device located partially within an inner cavity defined by the tool body, and moving a second drop ball over a second aperture of the engagement device, wherein the second drop ball has a second drop ball diameter that is larger than the first drop ball diameter.

9. The method of claim 8, further comprising engaging one or more casing scrapers positioned on the perimeter of the tool body with the wellbore.

* * * * *